US010996601B2

(12) United States Patent
Taniguchi

(10) Patent No.: US 10,996,601 B2
(45) Date of Patent: May 4, 2021

(54) CHARGING DEVICE HAVING CLEANING ROLLER AND CHARGING ROLLER, AND IMAGE FORMING APPARATUS INCLUDING THE CHARGING DEVICE

(71) Applicant: KYOCERA Document Solutions Inc., Osaka (JP)

(72) Inventor: Ryo Taniguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/914,893

(22) Filed: Jun. 29, 2020

(65) Prior Publication Data

US 2021/0003951 A1 Jan. 7, 2021

(30) Foreign Application Priority Data

Jul. 4, 2019 (JP) ..... JP2019-125484

(51) Int. Cl.
*G03G 15/02* (2006.01)
*G03G 15/20* (2006.01)
*G03G 21/00* (2006.01)

(52) U.S. Cl.
CPC ..... *G03G 15/2053* (2013.01); *G03G 15/0258* (2013.01); *G03G 21/0058* (2013.01); *G03G 2221/1627* (2013.01)

(58) Field of Classification Search
USPC ..... 399/100
See application file for complete search history.

(56) References Cited

U.S. PATENT DOCUMENTS

2011/0052262 A1* 3/2011 Tomari ..... B32B 25/14 399/176
2012/0063804 A1* 3/2012 Yamashita ..... G03G 15/0258 399/100
2018/0275554 A1* 9/2018 Yamazaki ..... G03G 15/0225

FOREIGN PATENT DOCUMENTS

JP 2011-191548 A 9/2011

* cited by examiner

*Primary Examiner* — Q Grainger
(74) *Attorney, Agent, or Firm* — Studebaker & Brackett PC

(57) ABSTRACT

A charging device includes a charging roller, a cleaning roller, a pair of first supporting members, a pair of second supporting members and a pair of elastic members. The pair of first supporting members supports the charging roller in a rotatable manner. The pair of second supporting members supports the cleaning roller in a rotatable manner. The pair of elastic members is disposed between the first supporting members and the second supporting members, and pushes back the cleaning roller in a direction separate away from the charging roller. The second supporting member provided on one side in an axial direction of the cleaning roller has a roller-shift preventing part which blocks the cleaning roller. The elastic member provided on the one side in the axial direction pushes back the cleaning roller with force smaller than force of the elastic member provided on the other side in the axial direction.

8 Claims, 7 Drawing Sheets

COMPARATIVE EXAMPLE 2

CHARGING DEVICE HAVING CLEANING ROLLER AND CHARGING ROLLER, AND IMAGE FORMING APPARATUS INCLUDING THE CHARGING DEVICE

INCORPORATION BY REFERENCE

This application is based on and claims the benefit of priority from Japanese Patent application No. 2019-125484 filed on Jul. 4, 2019, which is incorporated by reference in its entirety.

TECHNICAL FIELD

The present invention relates to a charging device which charges a photosensitive drum and an image forming apparatus.

BACKGROUND

A charging device is sometimes provided with a cleaning body which cleans a charging roll. The cleaning body has a cleaning member wound around the outer circumference of an axial member spirally. A winding angle of the cleaning member is set to be smaller at both axial end portions than at a center portion such that cleaning performance of the cleaning member is higher at both the axial end portions. As a result, a large amount of foreign matter is removed from both the axial end portions where an amount of foreign matter is large among the surface of the charging roll.

However, because the above cleaning body has the spirally wound cleaning member, as the cleaning body is rotated around an axis, a force acts in a direction in which the spiral (a screw) advances, and the balance of the forces (pressing force) applied to both the axial end portions of the shaft part is lost. Then, because the rotational load of the shaft part increases or decreases, the cleaning body cannot be rotated smoothly, and it becomes difficult to clean the charging roller suitably.

SUMMARY OF THE INVENTION

In accordance with one aspect of the present disclosure, a charging device includes a charging roller, a cleaning roller, a pair of first supporting members, a pair of second supporting members and a pair of elastic members. The charging roller rotates around an axis while coming into contact with a photosensitive drum to charge the photosensitive drum. The cleaning roller has a cleaning member spirally formed around an outer circumferential face of a shaft part, and rotates around an axis while making the cleaning member press on the charging roller to clean the charging roller. The pair of first supporting members supports both axial end portions of the charging roller in a rotatable manner. The pair of second supporting members supports both axial end portions of the shaft part in a rotatable manner. The pair of elastic members is disposed between the first supporting members and the second supporting members, and pushes back the cleaning roller in a direction separate away from the charging roller. The second supporting member provided on one side in an axial direction of the shaft part has a roller-shift preventing part which blocks the cleaning roller to be shifted in the one side in the axial direction as the spiral cleaning member is rotated while coming into contact with the charging roller. The elastic member provided on the one side in the axial direction pushes back the cleaning roller with force smaller than force of the elastic member provided on the other side in the axial direction.

In accordance with one aspect of the present disclosure, an image forming apparatus includes an image forming part configured to form an image on a sheet. The image forming part includes the charging device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, one embodiment of the present disclosure will be described. "Fr", "Rr", "L", "R", "U" and "D" marked in each figure respectively show "front", "rear", "left", "right", "upper" and "lower". In the specification, although terms showing direction and position are used, these terms are used for convenience of description, and do not limit the technical scope of the present disclosure.

Figure 1:
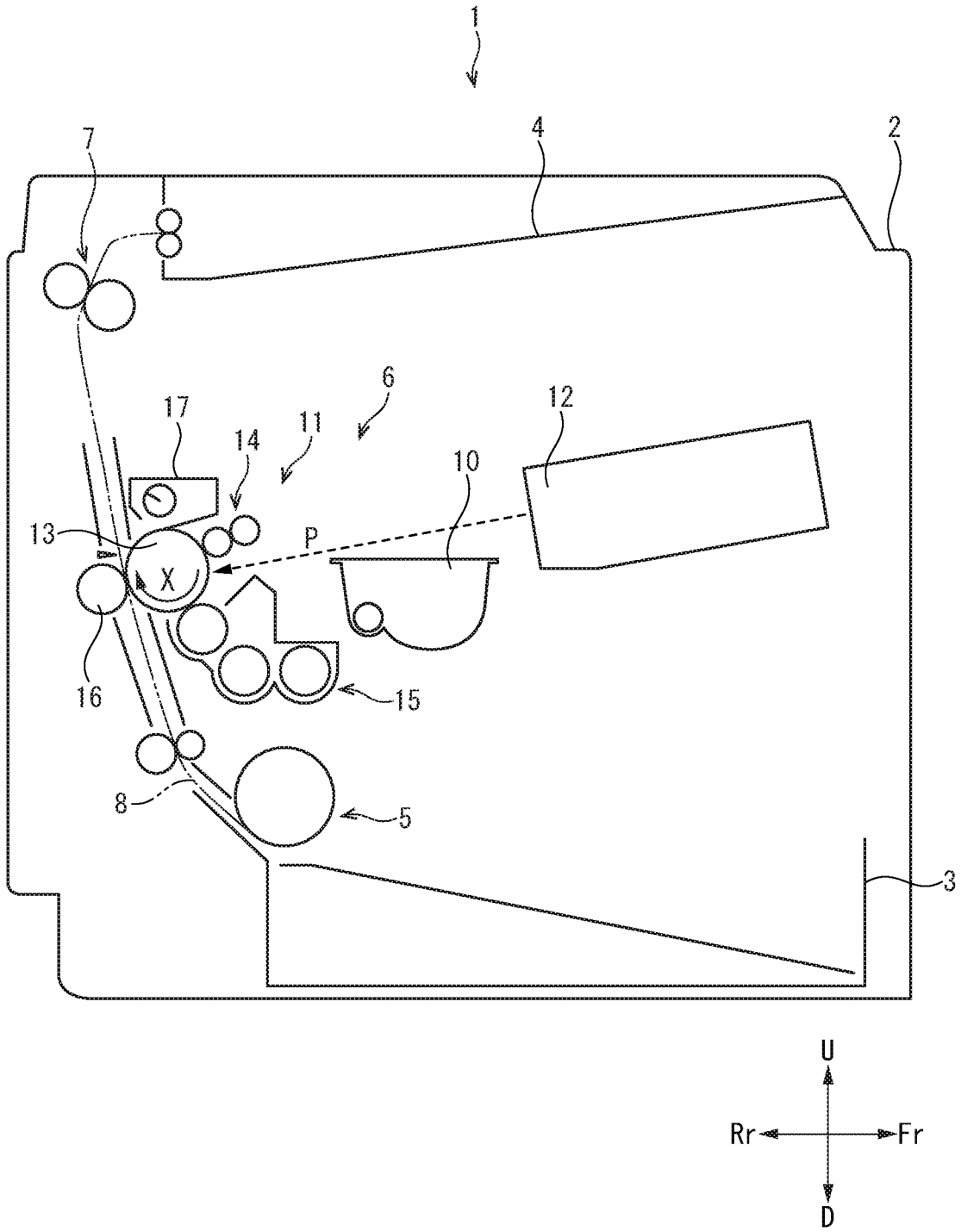
FIG. 1 is a view (a side view) schematically showing an inner structure of a printer according to one embodiment of the present invention.
Figure 2:
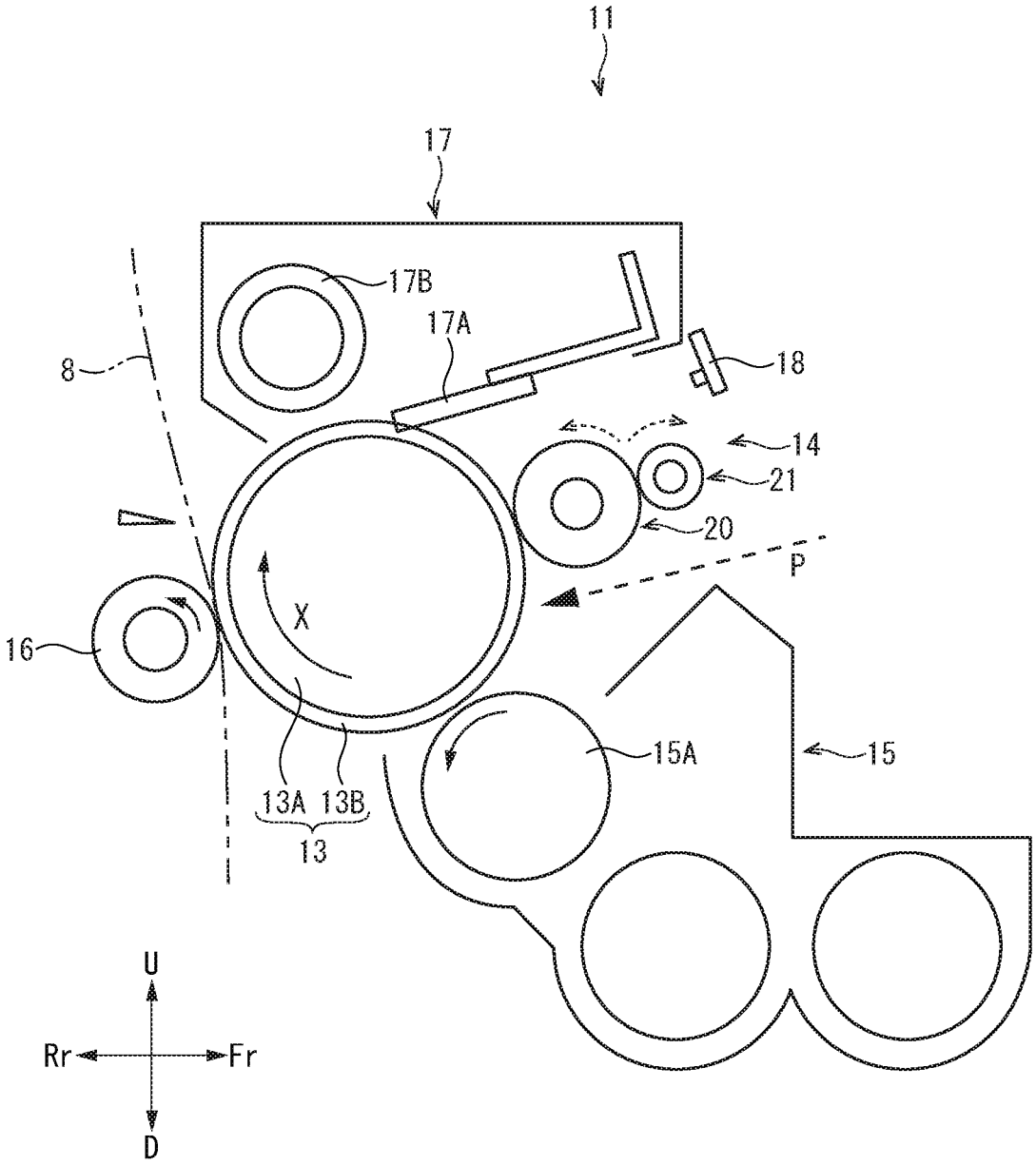
FIG. 2 is a view (a side view) schematically showing an image forming unit of the printer according to the embodiment of the present invention.
Figure 3:
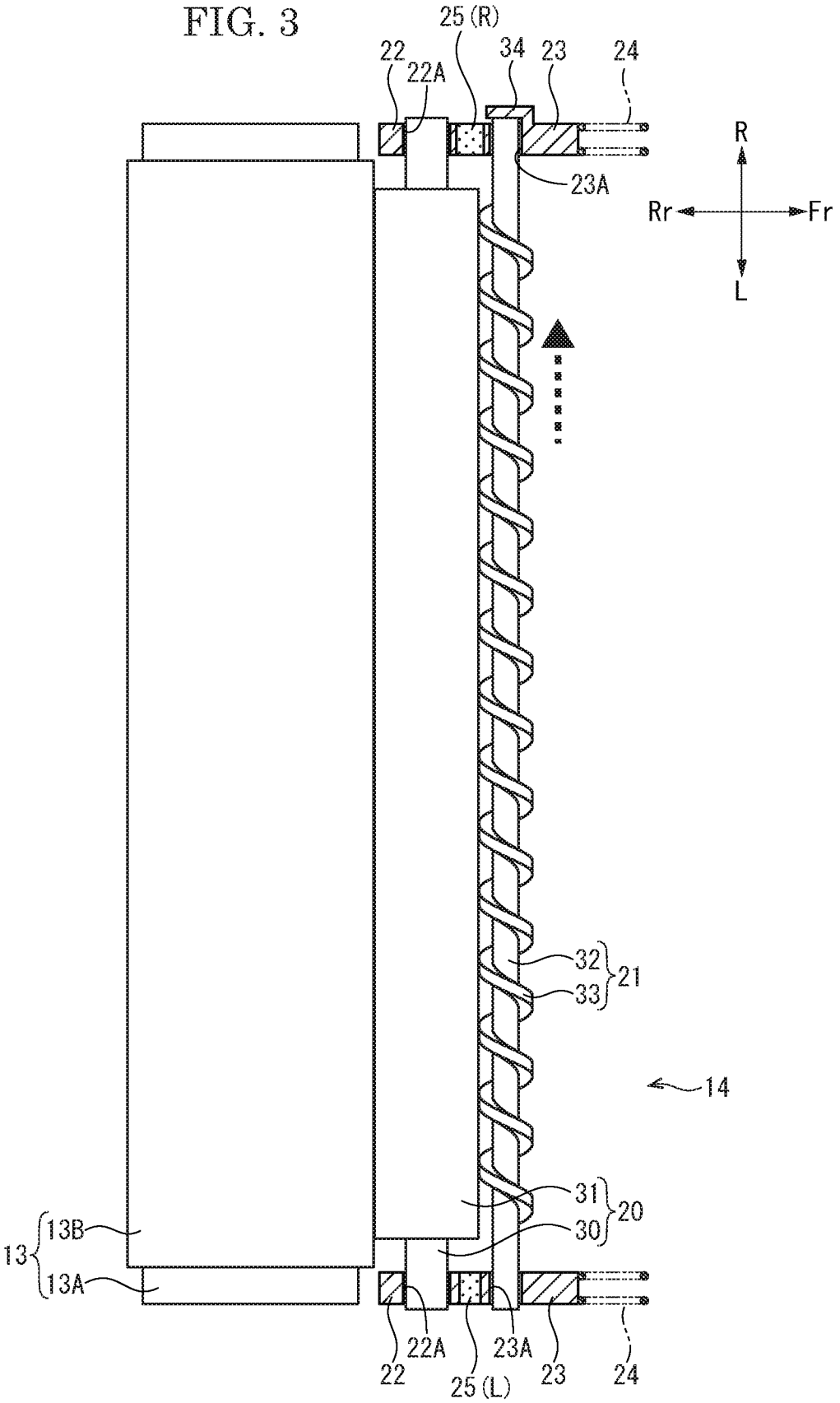
FIG. 3 is a plan view showing a charging device and a photosensitive drum according to the embodiment of the present invention.

[Outline of printer] A printer 1 as an example of an image forming apparatus will be described. FIG. 1 is a view (a side view) schematically showing an inner structure of the printer 1. FIG. 2 is a view (a side view) schematically showing an image forming unit 11 of the printer 1. FIG. 3 is a plan view showing a charging device 14 and a photosensitive drum 13.

As shown in FIG. 1, the printer 1 includes an apparatus main body 2 constituting an approximately parallelepiped outer appearance. In the lower portion of the apparatus main body 2, a sheet feeding cassette 3 storing a paper sheet (not shown) is detachably provided. On the upper face of the apparatus main body 2, a discharge tray 4 is provided.

The printer 1 includes a sheet feeding device 5, an image forming part 6 and a fixing device 7 which are stored in the apparatus main body 2. The sheet feeding device 5 is provided at the upstream end portion of a conveyance path 8 extending from the sheet feeding cassette 3 to the discharge tray 4. The fixing device 7 is provided on the downstream portion of the conveyance path 8, and the image forming part 6 is provided on the conveyance path 8 between the sheet feeding device 5 and the fixing device 7.

The image forming part 6 includes a toner container 10, an image forming unit 11 and an optical scanning device 12. The image forming unit 11 is disposed on the rear side of the toner container 10, and the optical scanning device 12 is disposed in front of the toner container 10. The image forming part 6 performs a monochrome image forming processing on the sheet based on image data sent from a personal computer (not shown), for example.

The toner container 10 is formed into a hollow box-shape, and contains a black toner (a developer) for replenishment, for example. The optical scanning device 12 is a device which emits scanning light on the surface of the charged photosensitive drum 13 to form an electrostatic latent image.

As shown in FIG. 1 and FIG. 2, the image forming unit 11 includes a photosensitive drum 13, a charging device 14, a development device 15, a transferring roller 16 and a cleaning device 17. The charging device 14, the development device 15, the transferring roller 16 and the cleaning device 17 are disposed around the photosensitive drum 13 in a transferring process (refer to the arrow X).

<Photosensitive drum> As shown in FIG. 2 and FIG. 3, the photosensitive drum 13 is formed into a cylindrical shape long in the left-and-right direction. The photosensitive drum 13 has an electric conductive blank tube 13A and a photosensitive layer 13B formed around the outer circumferential face of the blank tube 13A. To one axial end portion of the photosensitive drum 13 (the blank tube 13A), a driving device (not shown) such as a motor is connected via a driving force transmitting mechanism such as a gear train. The photosensitive drum 13 is driven by the driving device to be rotated around an axis.

<Charging device> The charging device 14 charges the photosensitive layer 13B uniformly with a predetermined polarity and at a predetermined potential by rotating a charging roller 20 around an axis while coming into contact with the photosensitive drum 13 (the photosensitive layer 13B) (a contact charging type method). The charging device 14 will be described later in detail.

<Development device> As shown in FIG. 2, the development device 15 includes a development roller 15A provided in parallel with the photosensitive drum 13 and spaced apart from the photosensitive drum 13. The development roller 15A is applied with development bias from a power source, and supplies the toner to the electrostatic latent image formed on the photosensitive drum 13 while rotating around an axis (develops the electrostatic latent image to form a toner image).

<Transferring roller> The transferring roller 16 is provided in parallel with the photosensitive drum 13 and comes into contact with the photosensitive drum 13 with a predetermined pressure. The transferring roller 16 presses the sheet on the photosensitive drum 13 to transfer the toner image developed on the photosensitive drum 13 to the sheet.

<Cleaning device> The cleaning device 17 includes a cleaning blade 17A coming into contact with the surface of the photosensitive drum 13. As the photosensitive drum 13 is rotted, the tip end portion of the cleaning blade 17A is relatively moved while coming into contact with the surface of the photosensitive drum 13, and removes the toner remaining on the surface of the photosensitive drum 13. The cleaning device 17 includes a discharge screw 17B discharging the removed toner to a waste toner bottle (not shown).

Between the charging device 14 and the cleaning device 17, an erasing device 18 is provided, which emits erasing light to erase charge remaining on the photosensitive layer 13B of the photosensitive drum 13.

[Image forming processing] An operation of the printer 1 will be described. A controller (not shown) of the printer 1 controls each device suitably to perform an image forming processing as follows. The charging device 14 charges the surface of the photosensitive drum 13 at a predetermined potential. The photosensitive drum 13 receives the scanning light (refer to the arrow P in FIG. 1 and FIG. 2) emitted from the optical scanning device 12 and carries the electrostatic latent image. The development device 15 develops the electrostatic latent image carried on the photosensitive drum 13 into a toner image by using the toner supplied from the toner container 10. The sheet is fed by the sheet feeding device 5 from the sheet feeding cassette 3 to the conveyance path 8. The transferring roller 16 transfers the toner image on the photosensitive drum 13 to the sheet passing between the transferring roller 16 and the photosensitive drum 13. The fixing device 7 fixes the toner image to the sheet using heat. Then, the sheet is discharged on the discharge tray 4. The cleaning device 17 (the cleaning blade 17A) removes the toner remaining on the photosensitive drum 13, and the erasing device 18 erases the charge remaining on the photosensitive layer 13B of the photosensitive drum 13.

[Structure of charging device] Next, as shown in FIG. 3, the charging device 14 will be described. The charging device 14 includes a charging roller 20, a cleaning roller 21, a pair of first supporting members 22, a pair of second supporting members 23, a pair of biasing members 24 and a pair of elastic members 25.

<Charging roller> The charging roller 20 is formed into a columnar shape long in the left-and-right direction, and is disposed in parallel with the photosensitive drum 13. The charging roller 20 has a charging shaft part 30 and a charging rubber layer 31.

The charging shaft part 30 is made of electric conductive metal such as aluminum alloy or stainless steel, and formed into a columnar shape. The charging rubber layer 31 is layered on the outer circumferential face of the charging shaft part 30. The charging rubber layer 31 is made of epichlorohydrin rubber combined with ion conductive agent, for example, and has electric conductivity. The charging roller 20 is electrically connected to a power source (not shown) to apply charging bias.

<Cleaning roller> The cleaning roller 21 is disposed on an opposite side to the photosensitive drum 13 with respect to the charging roller 20. The cleaning roller 21 is formed into an approximately cylindrical shape long in the left-and-right direction, and disposed in parallel with the charging roller 20. The cleaning roller 21 has a cleaning shaft part 32 (a shaft part) and a cleaning member 33.

The cleaning shaft part 32 is made of metal, such as aluminum alloy or stainless steel, and formed into a columnar shape long in the left-and-right direction. The cleaning member 33 is spirally formed around the outer circumferential face of the cleaning shaft part 32. In detail, the cleaning member 33 is made of elastic deformable porous material such as urethan sponge, and formed into an approximately stripe shape, for example. The cleaning member 33 is spirally wound around the cleaning shaft part 32. The cleaning material 33 is wound along a direction in which the spiral advances in the right direction as the cleaning shaft part 32 is rotated (a direction in which the screw is screwed). The cleaning member 33 is fixed on the outer circumferential face of the cleaning shaft part 32 by adhesive or double-side adhesive tape.

<First supporting member> Each first supporting member 22 is made of high rigid metal or synthetic resin, and formed into an approximately plate-like shape. The pair of first supporting members 22 is members which support both the axial end portions of the charging roller 20 (the charging shaft part 30) in a rotatable manner. Specifically, each first supporting member 22 has a first bearing portion 22A into which the axial end portion of the charging shaft part 30 is fitted. Each first bearing portion 22A supports the charging shaft part 30 rotating around an axis.

<Second supporting member> Each second supporting member 23 is made of high rigid metal or synthetic resin, and formed into an approximately plate-like shape. The pair of second supporting members 23 is members which support both the axial end portions of the cleaning shaft part 32 in a rotatable manner. Specifically, each second supporting member 23 has a second bearing portion 23A into which the axial end portion of the cleaning shaft part 32 is fitted. Each second bearing portion 23A supports the cleaning shaft part 32 rotating around an axis. Each second supporting member 23 is supported by the first supporting member 22 via a rotation shaft (not shown). Each second supporting member 23 is rocked around the rotation shaft to be closer to or separated away from the first supporting member 22.

The cleaning roller 21 is rotated around the axis while the spiral cleaning member 33 coming into contact with the charging roller 20. Assuming the spiral cleaning member 33 to be a screw, as the cleaning roller 21 is rotated, the cleaning roller 21 is applied with a force in a direction in which the screw is screwed (a direction in which the screw advances), that is, a force to the right direction, with respect to the charging roller 2. Then, the right second supporting member 23 has a roller-shift preventing part 34 which blocks the cleaning roller 21 when the cleaning roller 21 is shifted in the right direction as the spiral cleaning member 33 is rotated while coming into contact with the charging roller 20. The roller-shift preventing part 34 extends in an approximately L-shape from the axial outer face of the right second supporting member 23 so as to cover the second bearing portion 23A from the axial outer side. The right end face of the cleaning shaft part 32 penetrating the second bearing portion 23A comes into contact with the roller-shift preventing part 34, and the shift of the rotating cleaning roller 21 in the right direction is restricted.

The first and second bearing portions 22A and 23A may be any portion capable of supporting the rotating charging shaft part 30 and the cleaning shaft part 32, and may be a rolling bearing such as a ball bearing and a sliding bearing made of low frictional resin, for example.

<Biasing member> Each biasing member 24 is a compression spring, for example. The biasing members 24 are disposed between the front end portions of the second supporting members 23 and the apparatus main body 2 (the frame thereof), and bias the second supporting member 23 to the first supporting member 22. That is, the pair of biasing members 24 biases the cleaning roller 21 to the charging roller 20 via the pair of second supporting members 23. Furthermore, because the second supporting members 23 are coupled to the first supporting members 22 via the elastic members 25 described later, biasing force of the biasing members 24 is transmitted to the first supporting members 22 via the second supporting members 23 and the elastic members 25. As a result, the biasing members 24 bias the charging roller 20 to the photosensitive drum 13.

<Elastic member> Each elastic member 25 is made of silicon rubber or polyurethane rubber, for example. The elastic members 25 are disposed between the first supporting members 22 and the second supporting members 23, and press the first supporting members 22 and the second supporting members 23 in directions in which they are separated away each other. That is, the pair of elastic members 25 push back the cleaning roller 21 in a direction separate away from the charging roller 20 against a part of the pressing force of the cleaning roller 21. Hereinafter, the elastic member 25 disposed on the right side (one side in the axial direction) is marked with a reference "(R)" and the elastic member 25 disposed on the left side (the other side in the axial direction) is marked with a reference "(L)". In a description common to the pair of elastic members 25, Arabic numeral is only used as a reference.

The right elastic member 25(R) has a thickness in the front-and-rear direction (a direction to push back the cleaning roller 21) thicker than a thickness of the left elastic member 25(L). Accordingly, the elastic members 25 each has elasticity (resilience) different from each other, and the right elastic member 25(R) pushes back the cleaning roller 21 with a force smaller than that of the left elastic member 25(L). Specifically, the elasticity of the right elastic member 25(R) is about 80 to 90% of the elasticity of the left elastic member 25(L), preferably. The biasing force of the above described biasing members 24 is set to be higher than the pushing back force of the elastic members 25. Accordingly, the cleaning roller 21 is prevented from being separated away from the charging roller 20 by the elasticity of the elastic members 25.

[Operation of charging device] Next, an operation of the charging device 14 will be described.

The charging roller 20 and the cleaning roller 21 are biased by the pair of biasing members 24, the charging roller 20 comes into contact with the photosensitive drum 13 with a predetermined pressure, and the cleaning roller 21 comes into contact with the charging roller 20 with a predetermined pressure. The charging roller 20 is driven by the photosensitive drum 13 to be rotated around the axis, and the cleaning roller 21 is driven by the charging roller 20 to be rotated around the axis. The charging roller 20 is supplied with the charging bias from the power source, is rotated while coming into contact with the photosensitive drum 13 and charges the photosensitive drum 13 (the photosensitive layer 13B).

When the image forming operation described above is performed, a foreign matter, such as the toner remaining on the photosensitive drum 13 without transferred to the sheet, is removed from the photosensitive drum 13 by the cleaning device 17. The foreign matter, such as a small diameter additive in the toner, is passed through the cleaning device 17 (the cleaning blade 17A) and adhered on the surface of the charging roller 20.

The cleaning roller 21 is rotated around the axis while making the cleaning member 33 press on the charging roller 20, and cleans (scrapes) the foreign matter adhered on the surface of the charging roller 20. As described above, as the spiral cleaning member 33 is rotated while coming into contact with the charging roller 20 and a force to shift the cleaning roller 21 in the right direction is generated, the right end face of the cleaning shaft part 32 is pressed on the roller-shift preventing part 34 (refer to the thick dotted line arrow in FIG. 3). In a state where the right end face of the cleaning shaft part 32 is pressed on the roller-shift preventing part 34, when the cleaning roller 21 is rotated, the cleaning roller 21 hits on the roller-shift preventing part 34 or is bounced from the roller-shift preventing part 34. Then, the cleaning roller 21 vibrates in various directions (the axial direction, the radial direction and the circumferential direction). In this case, because balance between the forces applied to both the end portions of the cleaning shaft part 32 is lost, the pressing force of the cleaning roller 21 (the cleaning member 33) to the charging roller 20 becomes uneven in the axial direction. Thereby, it becomes difficult to clean the charging roller 20 by the cleaning roller 21 (the cleaning material 33) suitably.

Then, in the charging device 14 according to the present embodiment, the elasticity (the resilience) of the right elastic member 25(R) is set to be smaller than the elasticity of the left elastic member 25(L), and the softer elastic member 25(R) absorbs the vibration generated at the rotation on a side of the roller-shift preventing part 34.

Figure 4:
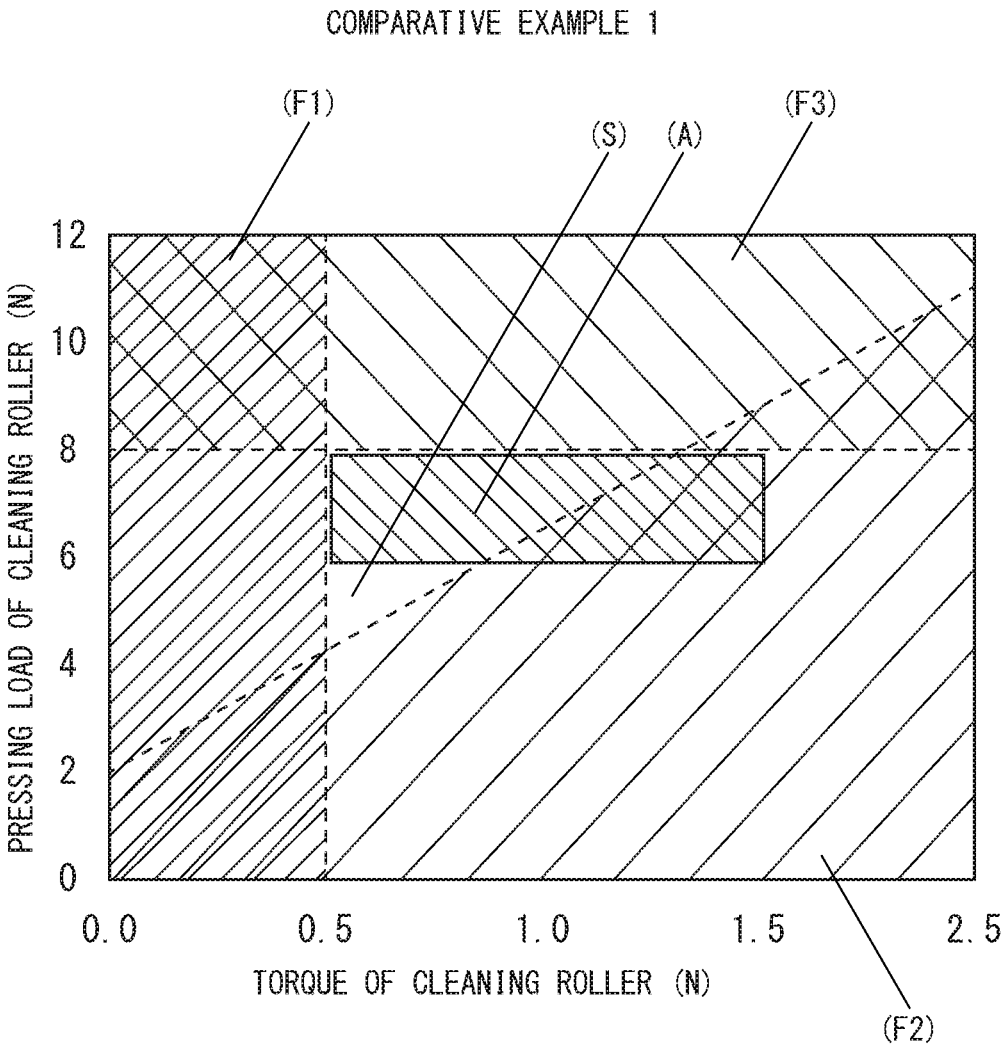
FIG. 4 PRIOR ART
FIG. 4 is a graph showing a test result of a charging device according to a comparative example 1.
Figure 5:
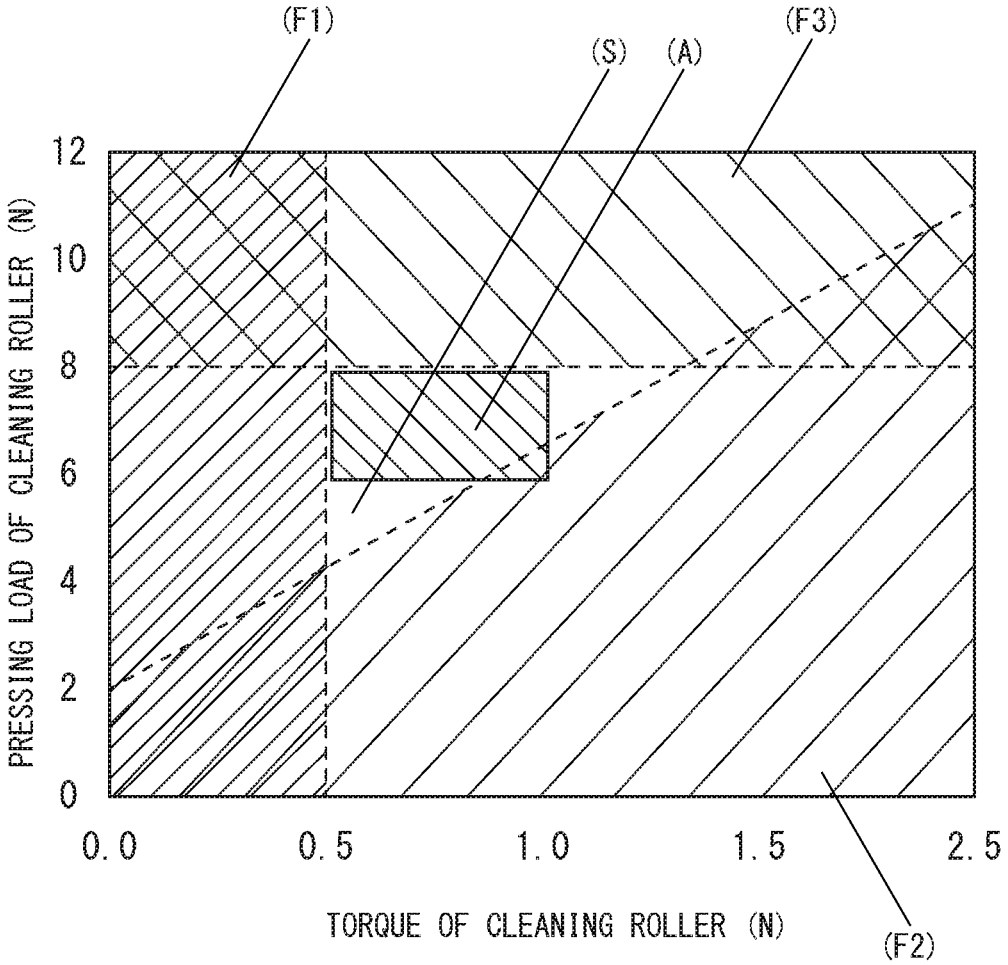
FIG. 5 PRIOR ART
FIG. 5 is a graph showing a test result of a charging device according to a comparative example 2.
Figure 6:
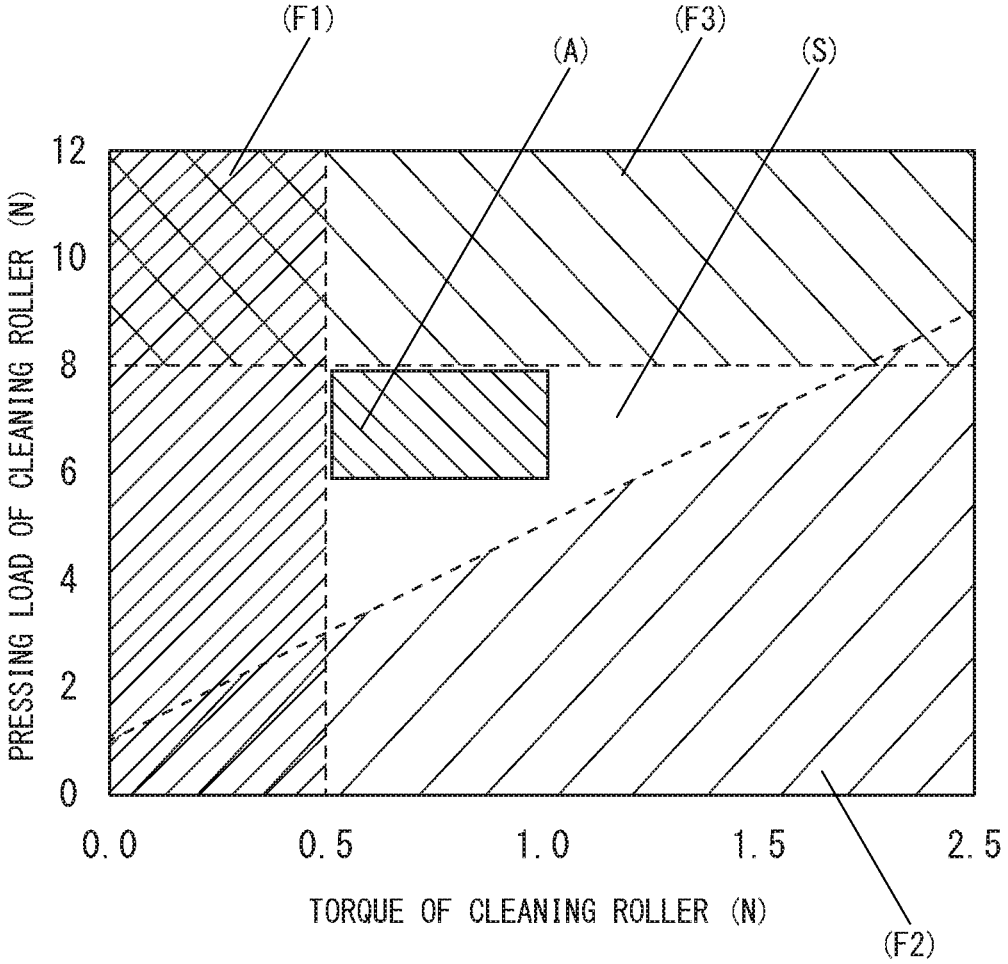
FIG. 6 is a graph showing a test result of the charging device according to the embodiment of the present disclosure.

[Test result] Next, with reference to FIG. 4 to FIG. 6, a result of testing an effect of the charging device 14 according to the present embodiment will be described. FIG. 4 is a graph showing a test result of a charging device according to a comparative example 1. FIG. 5 is a graph showing a test result of a charging device according to a comparative example 2. FIG. 6 is a graph showing a test result of the charging device 14 of the present embodiment.

In this test, a pressing load of the cleaning roller 21 on the charging roller 20 by the biasing member 24, a biting amount of the cleaning roller 21 to the charging roller 20 and the others are set to be within a predetermined range (hereinafter, called "the design range A" simply), and it is confirmed whether the following three failures occur in the design range A. In detail, as shown in FIG. 4 to FIG. 6, in a graph in which the vertical axis represents a pressing load (N) of the cleaning roller 21 to the charging roller 20 by the biasing members 24 and the horizontal axis represents a torque (N) of the cleaning roller 21, a region where the above three failures occur and the other region (hereinafter, called "the functional window S") are shown, and it is confirmed whether the design range A is contained in the functional window S.

Here, the three failures contain a cleaning failure of the charging roller 20 (F1) (hereinafter, called "the cleaning failure F1" simply), an uneven charging of the photosensitive drum 13 (F2) (hereinafter, called "the uneven charging F2" simply) and a deformation of the charging roller 20 (F3)(hereinafter, called "the deformation F3" simply). The cleaning failure F1 shows that a vertical stripe-shaped abnormal image occurs on the sheet when a high density printing (for example, a printing ratio is 25%) is carried out in a low temperature and low humidity environment (for example, a temperature (Celsius) is 10 degrees and a humidity is 10%). The uneven charging F3 shows that the image on the sheet has uneven density in the low temperature and low humidity environment. The deformation F3 shows that a horizontal strip-shaped abnormal image occurs on the sheet when the printing is carried out after leaving the charging device for five days in a high temperature and high humidity environment (for example, a temperature (Celsius) is 32.5 degrees and a humidity is 80%).

In this test, the charging device 14 according to the present embodiment is compared with the charging devices according to the comparative examples 1 and 2. The charging device of the comparative example 1 is not provided with the pair of elastic members 25. The charging device of the comparative example 2 is provided with the pair of elastic members 25 whose thickness are the same (3 mm). The charging device 14 of the present embodiment has the left elastic member 25(L) having a thickness of 3 mm and the right elastic member 25(R) having a thickness of 5 mm. In this test, the charging roller 20 having an outer diameter of 9.5 mm and the cleaning roller 21 having an outer diameter of 10 mm are used.

As shown in FIG. 4 to FIG. 6, in the charging device 14 according to the present embodiment and in the charging devices according to the two comparative examples 1 and 2 (hereinafter, called "all of the charging devices 14"), when a torque of the cleaning roller 21 is decreased to about 0.5 N or lower, the cleaning failure F1 occurs. In all of the charging devices 14, when a pressing load of the cleaning roller 21 is about 8 N or higher, the deformation F3 occurs.

As shown in FIG. 4 and FIG. 5, in the charging devices of the two comparative examples 1 and 2, the uneven charging F2 occurred within a range lower than a straight line showing a linear relationship between increase of the pressing load of the cleaning roller 21 and increase of the torque of the cleaning roller 21 (the pressing load of the cleaning roller 21=4.5× the torque of the cleaning roller 21+2). In the charging devices of the two comparative examples 1 and 2, the functional window S where the three failures do not occur have approximately the same size (area). In the charging device of the comparative example 1, the design range A is not contained in the functional window S and protrudes outward largely. On the other hand, in the cleaning device of the comparative example 2, the pair of elastic members 25 is elastically deformed, and the outer diameter tolerance (error) of the cleaning roller 21 is absorbed. Then, compared with the charging device of the comparative example 1 where the elastic members 25 are not provided, it becomes possible to decrease a size of the design range A. However, in the charging device of the comparative example 2, even if the design range A has a small size, there is a region where is not contained in the functional window S.

On the contrary, as shown in FIG. 6, in the charging device 14 according to the present embodiment, the uneven charging F2 occurred within a range where the pressing load of the cleaning roller 21 is smaller than that in the case of the charging devices of the two comparative examples 1 and 2. That is, the straight line (the pressing load of the cleaning roller 21=4× the torque of the cleaning roller 21+1) is shifted in a direction in which the pressing load of the cleaning roller is decreased. According to the charging device 14 according to the present embodiment, it becomes possible to decrease a pressing load of the cleaning roller 21 and increase a size of the region where the three failures do not occur (the functional window S). Furthermore, according to the charging device 14 of the present embodiment, in the same manner as the charging device of the comparative example 2, it becomes possible to absorb the outer diameter tolerance (error) of the cleaning roller 21 by the elastic members 25 and to make a size of the design range A smaller than that of the charging device of the comparative example 1. As a result, the design range A can be contained in the functional window S. That is, according to the charging device 14 of the present embodiment, it becomes possible to eliminate the three failures (the cleaning failure F1, the uneven charging F2 and the deformation F3).

The above described charging device 14 according to the present embodiment has a configuration such that the roller-shift preventing part 34 blocks the cleaning roller 21 which is shifted in the right direction (in one direction of the axial direction) as the spiral cleaning member 33 is rotated while coming into contact with the charging roller 20. Additionally, the charging device 14 has a configuration such that the elastic members 25 are disposed between the first supporting members 22 supporting the charging roller 20 and the second supporting members supporting the cleaning roller 21, and a part of the pressing force of the cleaning roller 21 (the biasing force of the biasing member 24) is absorbed (canceled) According to the configurations, the elastic members 25 are elastically deformed so that it becomes possible to change a distance between the charging roller 20 and the cleaning roller 21 slightly, and it becomes possible to absorb the tolerance of the diameter (the outer diameter) of the cleaning roller 21. Furthermore, according to the configuration, because the right elastic member 25(R) has an elasticity (a resilience) smaller than that of the left elastic member 25(L), it becomes possible to effectively absorb the vibration generated when the one end portion of the cleaning shaft part 32 is rotated while being pressed on the roller-shift preventing part 34. As a result, a pressing force of the cleaning roller 21 (the cleaning member 33) to the charging roller 20 becomes approximately constant in the axial direction and the cleaning roller 21 is smoothly rotated while coming into contact with the charging roller 20, and, therefore, it become possible to clean the charging roller 20 suitably.

According to the charging device 14 of the present embodiment, because the elastic members 25 counteracts a part of the biasing force of the biasing member 24, it becomes possible to absorb the unnecessary vibration of the cleaning roller 21 while the cleaning roller 21 pressing on the charging roller 20.

According to the charging device 14 of the present embodiment, by making the right elastic member 25(R) thicker than the left elastic member 25(L), it becomes possible to make an elasticity of the right elastic member 25(R) smaller than an elasticity of the left elastic member 25(L). Thereby, the vibration of the one end portion of the cleaning shaft part 32 is effectively absorbed so that it becomes possible to rotate the cleaning roller 21 smoothly and to clean the charging roller 20 suitably.

[First modified example] The charging device 14 of the present embodiment has a configuration such that the elastic members 25 each has a thickness different from each other so as to have an elasticity (a resilience) different from each other. The present disclosure is not limited to the above configuration. For example, as the charging device 14 of a first modified example, the elastic members 25 may be formed to have the same thickness using rubbers each having a softness (a hardness) different from each other. That is, the right elastic member 25(R) may be made of rubber softer than the left elastic member 25(L) (the example is not shown). According to the charging device 14 of the first modified example, it becomes possible to make an elasticity of the elastic member 25(R) disposed closer to the roller-sift preventing part 34 smaller than an elasticity of the other elastic member 25(L), and the same operation and effect as the above described embodiment can be obtained. The elastic members 25 may be formed to have different thicknesses using rubbers having different softness (hardness) (the example is not shown).

Figure 7:
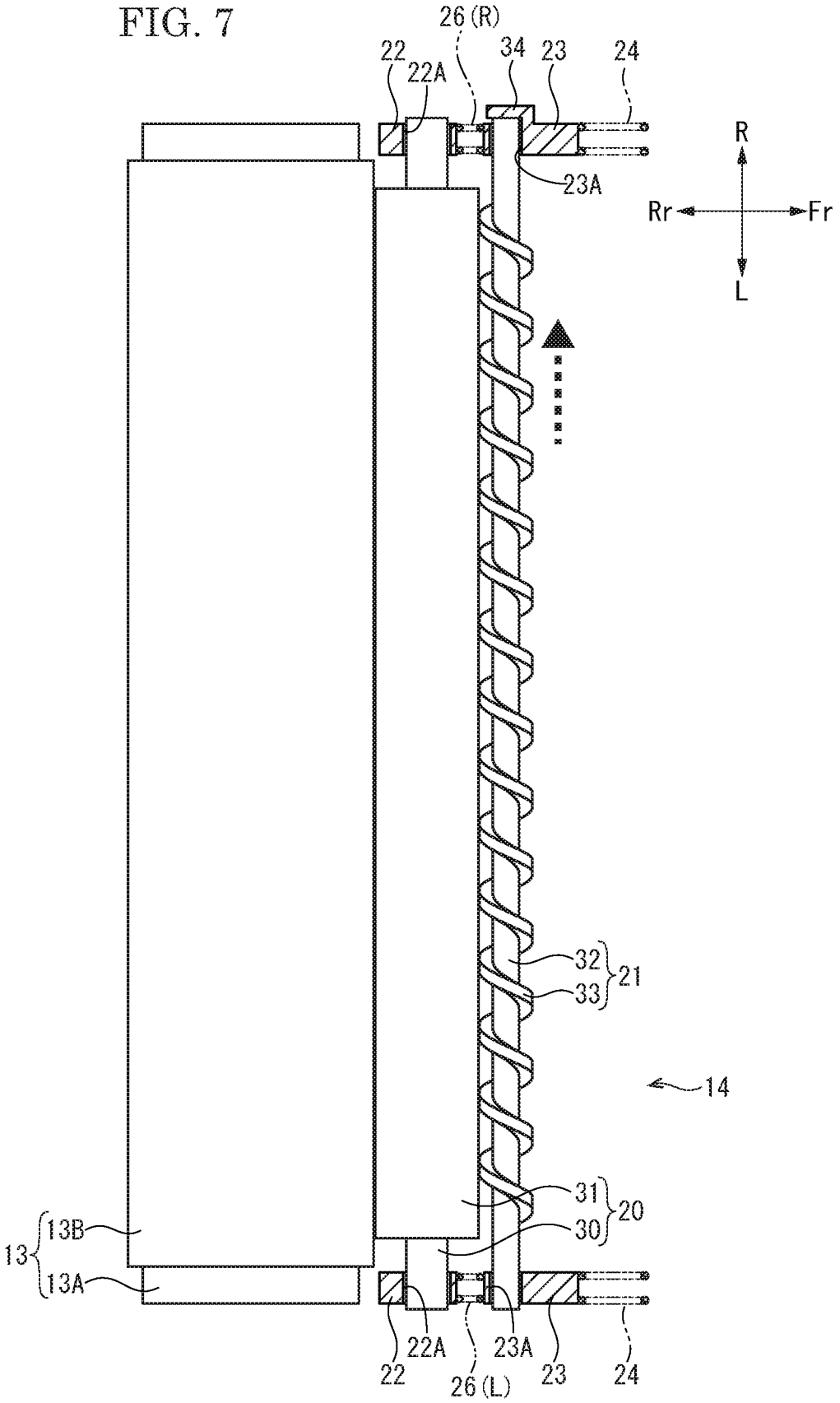
FIG. 7 is a plan view showing the charging device and the photosensitive drum of a second modified example according to the embodiment of the present invention.

[Second modified example] The charging device 14 of the present embodiment has a configuration such that the elastic members 25 are made of rubber. The present disclosure is not limited to the above configuration. For example, in the charging device 14 of the second modified example, as shown in FIG. 7, the elastic members 26 may be compression springs. In this case, the right elastic member 26(R) may have a spring constant smaller than a spring constant of the left elastic member 26(L). According to the charging device 14 of the second modified example, it becomes possible to make an elasticity of the elastic member 26(R) disposed closer to the roller-shift preventing member 34 smaller than an elasticity of the other elastic member 26(L), and the same operation and effect as the above described embodiment can be obtained. As the elastic members 26, a plate spring or the like may be used in place of a compression spring (the example is not shown).

[Third modified example] The charging device 14 of the present embodiment (including the first modified example and the second modified example) has a configuration such that the elastic members 25 and 26 are constituted by the rubber body or the spring. The present disclosure is not limited to the above configuration. For example, one of the elastic members 25 and 26 may be a rubber body, and the other of the elastic members 25 and 26 may be a spring (the example is not shown).

In the description of the above embodiments, the present disclosure is applied to the printer 1 as an example, but the present disclosure is not limited thereto. The present disclosure may be applied to a color printer, a copying machine, a facsimile or a multifunctional peripheral.

It should be noted that the description of the above embodiment shows one aspect of the charging device and the image forming apparatus according to the present disclosure, and the technical scope of the present disclosure is not limited to the above embodiments.

The invention claimed is:

1. A charging device comprising:

a charging roller rotating around an axis while coming into contact with a photosensitive drum to charge the photosensitive drum;

a cleaning roller having a cleaning member spirally formed around an outer circumferential face of a shaft part, and rotating around an axis while making the cleaning member press on the charging roller to clean the charging roller;

a pair of first supporting members supporting both axial end portions of the charging roller in a rotatable manner;

a pair of second supporting members supporting both axial end portions of the shaft part of the cleaning roller in a rotatable manner; and a pair of elastic members disposed between the first supporting members and the second supporting members, and pushing back the cleaning roller in a direction separate away from the charging roller, wherein the second supporting member provided on one side in an axial direction of the shaft part has a roller-shift preventing part which blocks the cleaning roller to be shifted in the one side in the axial direction as the spiral cleaning member is rotated while coming into contact with the charging roller, and the elastic member provided on the one side in the axial direction pushes back the cleaning roller with force smaller than force of the elastic member provided on the other side in the axial direction.

2. The charging device according to claim 1, further comprising a pair of biasing members biasing the cleaning roller to the charging roller via the pair of second supporting members, wherein the biasing members have biasing force larger than pushing back force of the elastic members.

3. The charging device according to claim 1, wherein the roller-shift preventing part comes into contact with an end face of the shaft part of the cleaning roller.

4. The charging device according to claim 1, wherein each of the elastic members is made of rubber, and the elastic member provided on the one side in the axial direction has a thickness in a direction in which the cleaning roller is pushed back thicker than a thickness of the elastic member provided on the other side in the axial direction.

5. The charging device according to claim 1, wherein each of the elastic members is made of rubber, and the elastic member provided on the one side in the axial direction is made of the rubber softer than the elastic member provided on the other side in the axial direction.

6. The charging device according to claim 1, wherein each of the elastic members is a spring, and the elastic member provided on the one side in the axial direction has a spring constant smaller than a spring constant of the elastic member provided on the other side in the axial direction.

7. The charging device according to claim 1, wherein a force with which the elastic member provided on the one side in the axial direction pushes back the cleaning roller is 80 to 90% of a force with which the elastic member provided on the other side in the axial direction pushes back the cleaning roller.

8. An image forming apparatus comprising an image forming part configured to form an image on a sheet, wherein the image forming part includes the charging device according to claim 1.

* * * * *